US006793507B2

(12) United States Patent
Sandoval et al.

(10) Patent No.: US 6,793,507 B2
(45) Date of Patent: Sep. 21, 2004

(54) CABLE CONNECTOR RISER

(75) Inventors: Alisa C. Sandoval, Grass Valley, CA (US); Chris Womack, San Diego, CA (US); Gregory S. Meyer, Rocklin, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/318,067

(22) Filed: Dec. 13, 2002

(65) Prior Publication Data

US 2004/0116000 A1 Jun. 17, 2004

(51) Int. Cl.[7] ..... H01R 12/00
(52) U.S. Cl. ..... 439/79
(58) Field of Search ..... 439/79, 83, 350, 439/357, 358, 660, 541.5

(56) References Cited

U.S. PATENT DOCUMENTS 5,468,154 A * 11/1995 Yip et al. ..... 439/79
5,591,036 A * 1/1997 Doi et al. ..... 439/79
5,713,746 A * 2/1998 Olson et al. ..... 439/79
6,012,931 A * 1/2000 Michaux et al. ..... 439/79
6,022,227 A * 2/2000 Huang ..... 439/79
6,168,462 B1 * 1/2001 Liao ..... 439/541.5
6,273,732 B1 * 8/2001 Johnescu et al. ..... 439/79
6,290,544 B1 * 9/2001 Gong et al. ..... 439/651
6,322,395 B1 * 11/2001 Nishio et al. ..... 439/607
6,328,591 B2 * 12/2001 Ushio et al. ..... 439/374
6,343,951 B1 * 2/2002 Ono et al. ..... 439/571
6,358,089 B1 * 3/2002 Kuroda et al. ..... 439/607

FOREIGN PATENT DOCUMENTS

| | | | |
|---|---|---|---|
| EP | 0 274 609 | * | 7/1988 |
| JP | 54-54292 | | 4/1979 |
| JP | 54-80584 | | 6/1979 |
| JP | 2-112181 | | 4/1990 |
| JP | 4-22084 | | 1/1992 |
| JP | 5-226034 | | 9/1993 |
| JP | 5-307131 | | 11/1993 |
| JP | 9-35790 | | 2/1997 |
| JP | 2000-260497 | | 9/2000 |
| JP | 2001-37063 | | 2/2001 |

OTHER PUBLICATIONS

Schematic Diagrams of Tyco/AMP Mate–N–Lok Connector, 7 pages, 3/00.

* cited by examiner

*Primary Examiner*—Tho D. Ta

(57) ABSTRACT

A cable connector riser is provided configured to be positioned between a circuit board side of a receiving connector and a circuit board. The cable connector riser has a base portion having a thickness sufficient to provide clearance for a housing of a mating connector on a cable, the housing including a portion projecting downward towards the circuit board from a bottom surface of the mating connector.

6 Claims, 4 Drawing Sheets

CABLE CONNECTOR RISER

BACKGROUND

Electrical connectors are commonly used to couple electrical cables to electrical circuit boards. Known connectors have long been used to provide releasable connections between power cables, for example, and circuit boards, where one of a male or female mating connector formed at an end of a power cable releasably engages the other of the male or female receiving connector mounted on a circuit board. These connectors, however, are designed to be positioned at an edge of the circuit board, and thus cannot be used in a central portion of a circuit board.

Thus, a need exists for an electrical connector which can be positioned at some distance from an edge of a circuit board, and an adapter for modifying known electrical connectors to do the same.

SUMMARY

According to one embodiment of the present invention, a cable connector riser is provided configured to be positioned between a circuit board side of a receiving connector and a circuit board. The cable connector riser has a base portion having a thickness sufficient to provide clearance for a housing of a mating connector on a cable, the housing including a portion projecting downward towards the circuit board from a bottom surface of the mating connector.

According to another embodiment of the present invention, a receiving connector is provided adapted to connect a mating connector to an electrical contact on a circuit board located at a distance from an outer edge of the circuit board such that a board side projection on the mating connector interfaces with a substantially vertical surface of the receiving connector. The receiving connector comprises a receiving portion configured to mate with the mating connector, the receiving portion including a latching portion configured to latch a corresponding latching portion of the mating connector, and a riser configured to be located between the receiving portion and the circuit board. The riser has a thickness sufficient to provide clearance for a projection of the mating connector on a circuit board side, the projection projecting downward towards the circuit board from a bottom surface of the mating connector.

According to another embodiment of the present invention, a receiving connector is provided adapted to connect a cable to an electrical contact on a circuit board. The receiving connector comprises means located at a distance from an outer edge of the circuit board for releasably mating with the cable such that a board side projection on the cable interfaces with a substantially vertical surface of the receiving connector, means for latching the cable to the cable connector, and means for providing sufficient clearance between the circuit board and the cable for the board side projection on the cable.

According to another embodiment of the present invention, a method of releasably attaching a cable to a circuit board is provided. The method comprises inserting a mating portion of the cable into a receiving connector located at a distance from an edge of the circuit board, and latching the cable to the receiving connector. The mating portion of the cable includes a board side projection projecting downward towards the circuit board from a bottom surface thereof.

DETAILED DESCRIPTION OF THE EMBODIMENTS

Reference will now be made in detail to exemplary embodiments of the invention. Wherever possible, the same reference numbers will be used throughout the drawings to refer to the same or like parts.

For purposes of explanation only, the following description will refer to a connector formed at a circuit board connection end of a cable as "a mating connector" and a corresponding through hole printed circuit board (PCB) connector mounted on a circuit board as "a receiving connector." No gender type is to be inferred from these terms. The mating connector at the end of the cable may be either a male or female connector or other convenient connection type. Likewise, the receiving connector may be the other of the male or female connector. It should also be appreciated that the term "cable" as set forth below may include one or more individual wires, the bundle of one or more wires being commonly referred to as "the cable" for purposes of simplicity.

Figure 3:
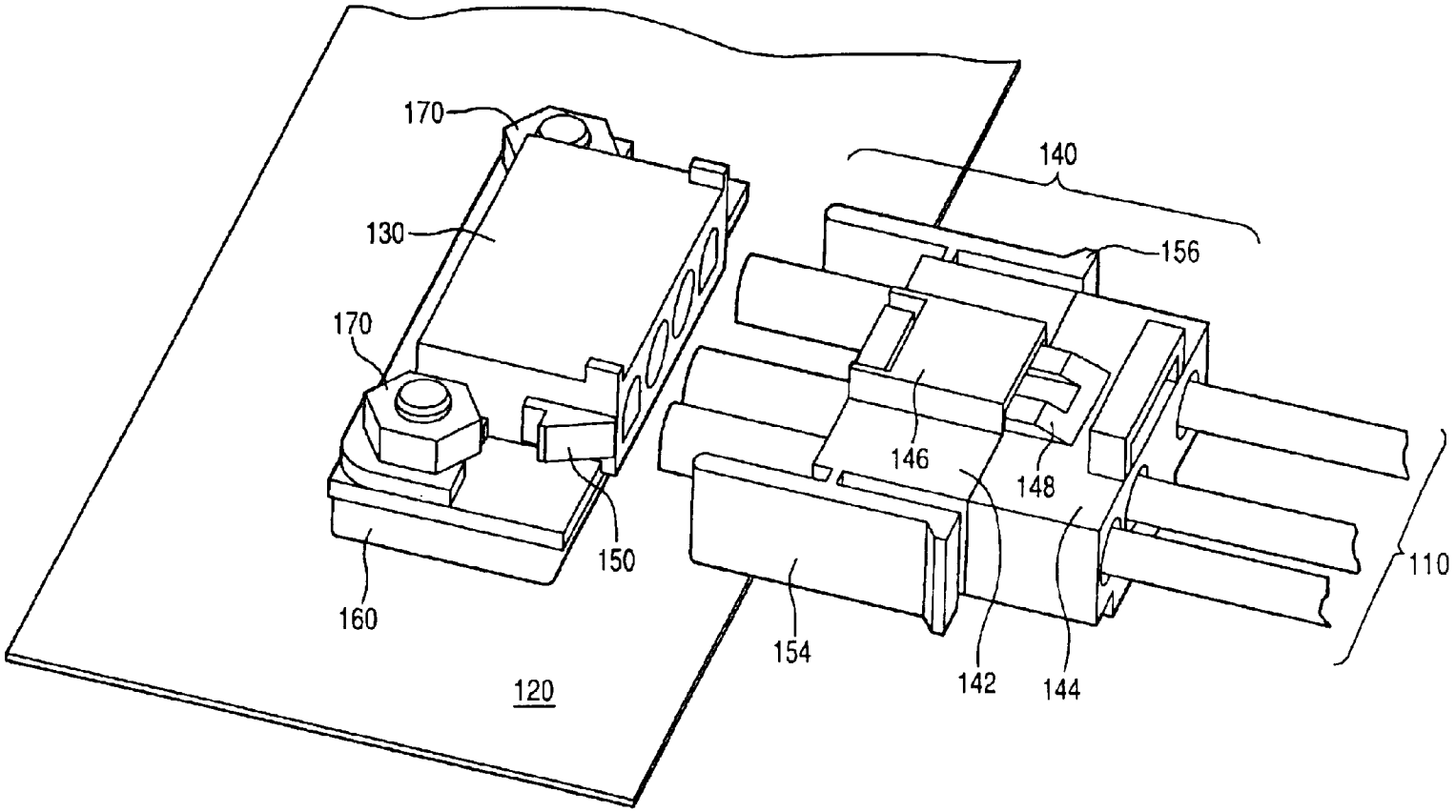
FIG. 3 is a perspective view of a cable connector according to an embodiment of the present invention shown with a male mating connector.
Figure 4:
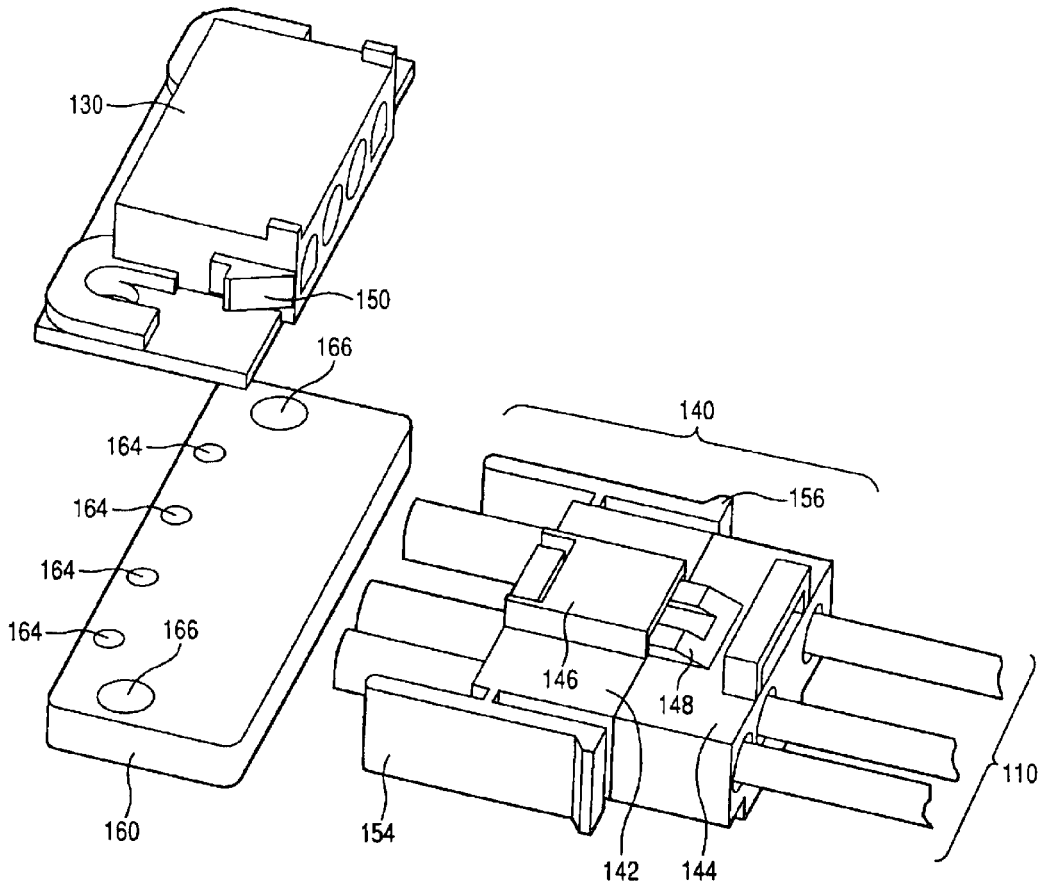
FIG. 4 is a separated perspective view of the cable connector and male mating connector of FIG. 3.

Referring to FIG. 3, an electrical coupling between a cable 110 and a circuit board 120 (FIG. 5) may be achieved by way of a receiving connector 130 mounted on the circuit board 120 (FIG. 5), and releasably engaging a mating connector 140 on a circuit board connection end of a cable 110. As shown in FIG. 3, an embodiment of the mating connector 140 may include two separable housing pieces 142, 144. A first piece 144 includes a standard wire interface for coupling the cable 110 to the mating connector 140. A second piece 142 is provided with a receiving portion (not shown) to releasably engage the first piece 144, and additionally with any one of a number of male ends for releasably engaging the receiving connector 130. The plurality of different male ends which can be employed allows a designer to select an appropriate coupling to the circuit board 120. The first piece 144 and the second piece 142 are provided with top latching portions 148 and 146 respectively for latching the first piece 144 to the second piece 142. As shown in the end view of FIG. 6, the first piece 144 and the second piece 142 are also provided with bottom latching portions, though only the bottom portion 147 corresponding to the top portion 146 of the second piece 142 can be seen in FIG. 6. The latching portions 146, and 147 are formed as part of the housing on the second piece 142. Similarly, the latching portion 148 (and, though not shown, an additional bottom latching portion corresponding to top latching portion 148) is formed as part of the housing on the first piece 144. The bottom latching portion 147 on the second piece 142 projects downward towards the circuit board 120 from a bottom surface of the cable 110.

Figure 5:
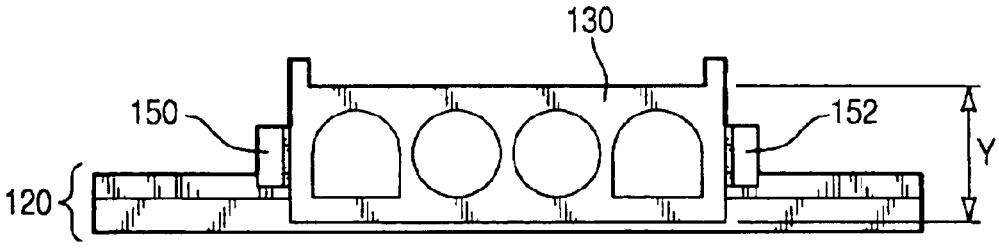
FIG. 5 is an end view of a female receiving connector according to an embodiment of the present invention.

In known applications of the aforementioned through hole PCB connector, in addition to latching the first piece 144 to the second piece 142, the bottom (i.e., circuit board side) latching portion 147 of the second piece 142 also acts as a side interface with an edge of the circuit board (FIG. 5) when coupled to the receiving connector 130. In other words, as shown in FIG. 5, the bottom latching portion 147 projects beneath the top surface of the circuit board 120, and a side portion thereof abuts a si de edge of the circuit board 120, such that the bottom latching portion 147 interfaces with a substantially vertical edge surface of the circuit board 120. This "edge interface" reduces the cable's 110 ability to move in the vertical direction when coupled to the receiving connector 130, thereby reducing any strain transfer to the circuit board 120 for heavy cables 110, and also reduces the likelihood of cable disconnect due to inadvertent wiggling of the cable 110.

In addition to the aforementioned latching portions of the first piece 144 and the second piece 142, the second piece 142 of the mating connector 140 is provided with side latching portions 154, 156 (FIG. 3) on each side. Similarly, the receiving connector 130 is provided with corresponding side latching portions 150, 152 (FIG. 5) on each side. The side latching portions 150, 152, 154, 156 are configured to latch the mating connector 140 to the receiving connector 130. The latching portions 154, 156 are provided on the side of the second piece 142 of the mating connector 140, so as to not interfere with the top and bottom latching portions 146 and 147. Other configurations are also possible, as would be readily apparent to one of ordinary skill in the art after reading this disclosure.

Figure 6:
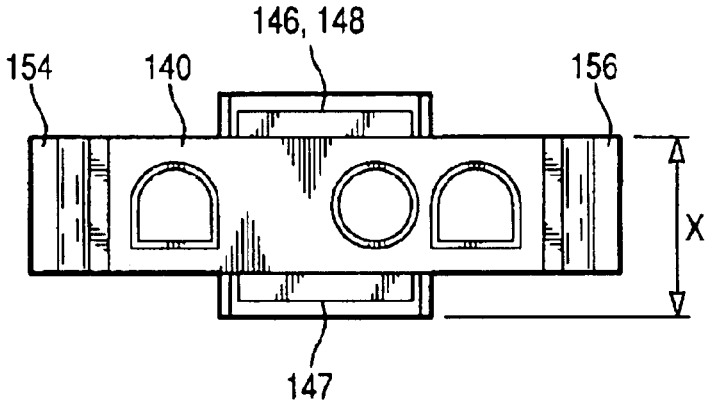
FIG. 6 is an end view of a male mating connector according to an embodiment of the present invention.

As set forth in greater detail above, known applications of the aforementioned through hole PCB connector are limited to applications where the receiving connector 130 is positioned at an edge of the circuit board 120 due to the edge interface between the circuit board side latching portion 147 of the second piece 142 and the edge of the circuit board 120. Problems arise when a receiving connector 130 is required at some distance from an edge of the circuit board 120 (i.e., at some internal/central location which may or may not be at a center of the circuit board 120). Specifically, the circuit board side latching portion 147 of the first piece 144 and second piece 142 causes the mating connector 140 to be vertically displaced above the circuit board 120 by some distance when the receiving connector 130 is not positioned at an edge of the circuit board 120. As shown in FIG. 6, for example, a thickness of the housing with lower latching portion 147 (i.e., X in FIG. 6) on the mating connector 140 is greater than the corresponding thickness of the housing on the receiving connector 130 (i.e, Y in FIG. 5). This thickness variance causes a corresponding gap between the bottom (i.e., circuit board side) of the receiving connector 130 and the circuit board 120 when the receiving connector 130 of known devices is positioned at some distance from an edge of the circuit board 120, thereby preventing a secure connection between the receiving connector 130 and the circuit board 120.

Figure 1:
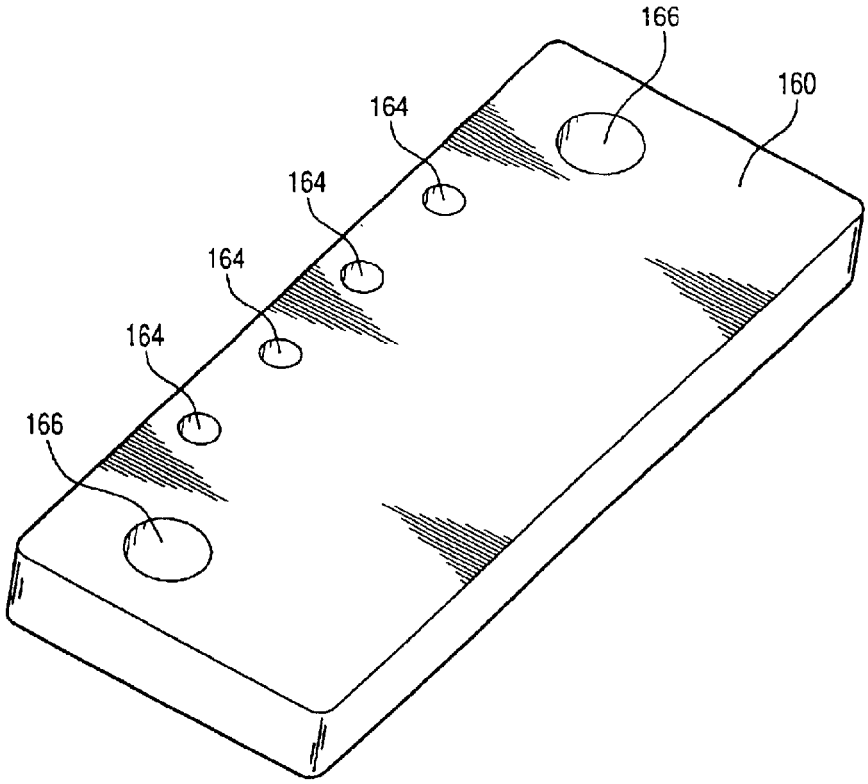
FIG. 1 is a perspective view of a riser block according to an embodiment of the present invention.

To address this problem, the present inventors have thus developed a riser block 160 (FIG. 1) to provide clearance for projections of the mating connector 140 housing on the circuit board side for receiving connectors 130 positioned at a distance from an edge of the circuit board 120. The riser block 160 is configured to have a thickness sufficient to provide clearance for the projection to eliminate the gap otherwise caused thereby (i.e., generally greater than or equal to X-Y), and also provides an edge interface between the bottom (i.e., circuit board side) latching portion 147 of the second piece 142 and a vertical side surface of the riser block 160. This allows for placement of the receiving connector 130 at a distance from an edge of the circuit board 140, while maintaining the interface with the bottom latching portion 147 of the second piece 142 to provide a rigid connection therewith. According to one embodiment of the present invention, the riser block 160 is also designed to have a periphery substantially conforming to an outer periphery of the receiving connector 130 (FIG. 3). This provides for a more secure support of the receiving connector 130 than other plausible configurations.

Figure 2:
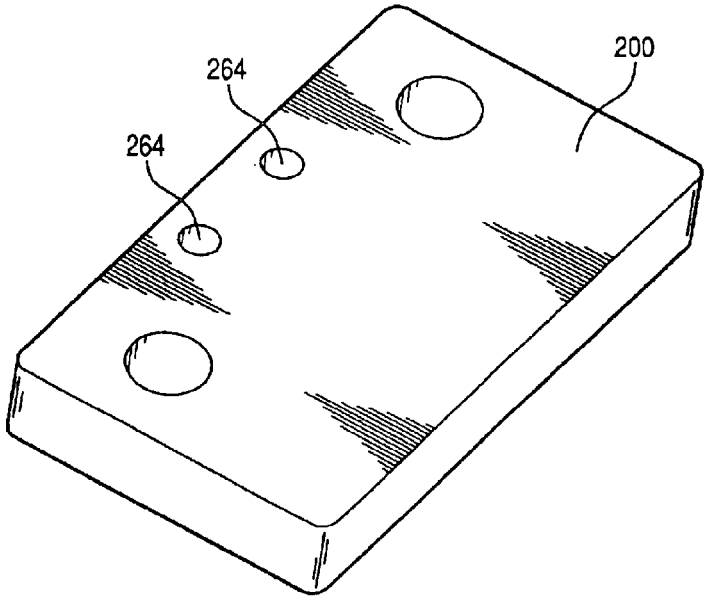
FIG. 2 is a perspective view another riser block according to an embodiment of the present invention.

The riser block 160 may include a plurality of through holes 164 for passing electrical contacts of the receiving connector 130 directly to the circuit board 120. In the case of electrical pin contacts, for example, the plurality of through holes 164 are configured to have a diameter larger than that of the electrical pin contacts. By way of example, for a 1.3 mm diameter electrical pin contact, the through holes 164 may be designed to have a diameter of at least 1.9 mm. The "enlarged" through holes 164 ensure ease of assembly. As shown, for example, in FIG. 2, the number of through holes 264 in the riser block 200 may vary depending on the particular implementation.

Alternatively, the through holes 164 may be configured to have an undersized diameter with respect to the electrical pin contacts. Undersized through holes 164 create a minor interference fit between the electrical pin contacts and the riser block 160 such that the riser block 160 can be press fit onto the receiving connector 130. The riser block 160 can then be held onto the receiving connector 130 via the interference with the electrical pin contacts, thereby allowing for pre-assembly of the riser block 160 to the receiving connector 130.

According to another embodiment of the present invention, the riser block 160 may be provided with a plurality of electrical contacts on a top surface for connection to the receiving connector 130, the electrical contact on the top surface being electrically coupled to a plurality of electrical contacts on a bottom surface for connection to the circuit board 120. Hence, the electrical contacts on the receiving connector 130 may be soldered to the electrical contacts on the top surface of the riser block 160, and the electrical contacts on the bottom surface of the riser block 160 may be soldered to electrical contacts on the circuit board 120.

The riser block 160 may also include a plurality of through holes 166 (FIG. 1) for passing a fastener 170 (FIG. 3) therethrough. By way of example, the fastener 170 may comprise one of a screw, and a bolt (with corresponding nut) (FIG. 3). The fastener 170 is used to securely fasten the receiving block 130 through the riser block 160 to the circuit board 120, particularly when used with heavy cables 110 (e.g., power cables). For lighter cables 110, the riser block 160 may be glued or soldered to the circuit board 120, and the receiving connector 130 similarly glued or soldered to the riser block 160. A variety of other attachment schemes may also be utilized, as would be readily apparent to one of ordinary skill in the art after reading this disclosure.

The riser block 160 can be made by any one of a number of materials including electrically conductive materials (e.g., metals) and non-conductive materials (e.g., plastics) depending on the particular implementation. However, to reduce thermal expansion/contraction differences between the riser block 160 and the receiving connector 130, the riser block 160 is typically manufactured from the same material as that of the receiving connector 130 or the circuit board 120. Such materials may include, for example, nylon, Acrylonitrile-Butadiene-Styrene (ABS), polypropylene, polyethylene blend, and/or other printed circuit board materials with ratings such as G-10.

According to one embodiment of the present invention, the aforementioned riser block 160 and the receiving connector 130 can be integrated into a single component. In other words, a base portion of the receiving connector can be formed to have a thickness (i.e., greater than or equal to X-Y as shown in FIGS. 5 and 6) sufficient to provide clearance for the circuit board side projection of the mating connector (i.e., latch 147). This eliminates the need for a separate riser block 160. Otherwise, this embodiment is similar to the separable riser block/receiving connector as previously described.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A receiving connector adapted to connect a mating connector to an electrical contact on a circuit board located at a distance from an outer edge of the circuit board such that a substantially vertical surface of a board side projection on the mating connector interfaces with a substantially vertical surface of the receiving connector, the receiving connector comprising:

a receiving portion configured to mate with the mating connector, the receiving portion including a latching portion configured to latch a corresponding latching portion of the mating connector; and a riser configured to be located between the receiving portion and the circuit board, wherein the riser has a thickness sufficient to provide clearance for the board side projection of the mating connector on a circuit board side, the board side projection projecting downward towards the circuit board from a bottom surface of the mating connector and having a substantially vertical surface thereof interfacing with the substantially vertical surface of the receiving connector.

2. The receiving connector of claim 1, wherein the receiving portion and the riser are formed as separate components.

3. The receiving connector of claim 1, wherein the receiving portion and the riser are integrally formed as one component.

4. The receiving connector of claim 1, wherein the riser includes a plurality of through holes for passing electrical contacts of the receiving connector therethrough.

5. The receiving connector of claim 1, wherein the riser includes a plurality of through holes for passing a fastener therethrough.

6. The receiving connector of claim 1, wherein the mating connector is thicker than the receiving portion.

* * * * *